US009279404B2

(12) United States Patent
Aoki et al.

(10) Patent No.: US 9,279,404 B2
(45) Date of Patent: Mar. 8, 2016

(54) FUEL SUPPLY DEVICE AND FUEL SUPPLY CONTROL METHOD FOR INTERNAL COMBUSTION ENGINE

(75) Inventors: Yozaburo Aoki, Kawasaki (JP); Tomohiko Takahashi, Isehara (JP); Takatsugu Katayama, Isehara (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 931 days.

(21) Appl. No.: 13/518,100

(22) PCT Filed: Dec. 8, 2010

(86) PCT No.: PCT/JP2010/071998

§ 371 (c)(1),
(2), (4) Date: Jun. 21, 2012

(87) PCT Pub. No.: WO2011/077951

PCT Pub. Date: Jun. 30, 2011

(65) Prior Publication Data

US 2012/0255521 A1 Oct. 11, 2012

(30) Foreign Application Priority Data

Dec. 22, 2009 (JP) ..... 2009-290205

(51) Int. Cl.
*F02D 17/04* (2006.01)
*F02M 63/02* (2006.01)
(Continued)

(52) U.S. Cl.
CPC ..... *F02M 63/0205* (2013.01); *F02D 41/222* (2013.01); *F02D 41/3845* (2013.01); *F02M 63/0245* (2013.01); *F02D 2041/223* (2013.01); *F02D 2200/0602* (2013.01)

(58) Field of Classification Search
CPC ..... F01M 1/24; F02D 17/04; F02D 19/022; F02D 19/025; F02D 19/027; F02D 41/38; F02D 41/3809; F02D 41/3845; F02M 63/0225; F02M 63/023; F02M 65/003
USPC ..... 123/494, 198 D, 198 DB; 73/114.43
See application file for complete search history.

(56) References Cited

U.S. PATENT DOCUMENTS 5,937,826 A * 8/1999 Olson et al. ..... 123/447
5,992,373 A * 11/1999 Hosoya et al. ..... 123/305
(Continued)

FOREIGN PATENT DOCUMENTS

CN 1624317 A 6/2005
CN 1676906 A 10/2005
(Continued)

OTHER PUBLICATIONS

Chinese Office Action dated Oct. 23, 2013, (5 pgs.).

*Primary Examiner* — Thomas Moulis
(74) *Attorney, Agent, or Firm* — Foley & Lardner LLP

(57) ABSTRACT

A fuel supply device includes a low-pressure fuel pump, a high-pressure fuel pump, an accumulator for accumulating the pressurized fuel, fuel injection valves, a relief valve for restricting an upper limit value of a fuel pressure in the accumulator, a high-pressure fuel pressure sensor, and a control unit for setting a target fuel injection pressure, controlling the high-pressure fuel pump so that the fuel pressure in the accumulator reaches the target fuel injection pressure, and regarding the present target fuel injection pressure as a detection value of the high-pressure fuel pressure sensor and setting the high-pressure fuel pump in an operational state with a maximum discharge amount or a non-operational state when detecting an abnormality of the high-pressure fuel pressure sensor. This enables the fuel to be injected with an appropriate injection pulse width corresponding to an actual fuel pressure even if the high-pressure fuel pressure sensor experiences disconnection.

7 Claims, 6 Drawing Sheets

(51) Int. Cl.
*F02D 41/22* (2006.01)
*F02D 41/38* (2006.01)

(56) References Cited

U.S. PATENT DOCUMENTS

| | | | | |
|---|---|---|---|---|
| 6,024,064 | A * | 2/2000 | Kato et al. | 123/179.17 |
| 6,578,555 | B2 * | 6/2003 | Sykes | 123/479 |
| 6,792,919 | B2 * | 9/2004 | Kohketsu et al. | 123/447 |
| 6,871,633 | B1 * | 3/2005 | Date et al. | 123/447 |
| 7,007,676 | B1 * | 3/2006 | Schuricht et al. | 123/479 |
| 7,383,804 | B2 * | 6/2008 | Wolber et al. | 123/179.16 |
| 7,987,704 | B2 * | 8/2011 | Lucido et al. | 73/114.43 |
| 8,091,532 | B2 * | 1/2012 | Wang et al. | 123/446 |
| 8,104,334 | B2 * | 1/2012 | Wang et al. | 73/114.43 |
| 8,133,083 | B2 * | 3/2012 | Fujino et al. | 440/1 |
| 8,220,322 | B2 * | 7/2012 | Wang et al. | 73/114.43 |
| 8,573,185 | B2 * | 11/2013 | Miura et al. | 123/458 |
| 8,666,639 | B2 * | 3/2014 | Saruwatari et al. | 701/107 |
| 8,738,218 | B2 * | 5/2014 | Suda et al. | 701/30.3 |
| 8,881,707 | B2 * | 11/2014 | Katsurahara | 123/198 D |
| 2002/0092504 | A1 | 7/2002 | Kohketsu et al. | |
| 2004/0208753 | A1 | 10/2004 | Mori | |
| 2005/0103312 | A1 | 5/2005 | Uchiyama | |
| 2005/0216173 | A1 | 9/2005 | Toyoshima et al. | |
| 2005/0263146 | A1 * | 12/2005 | Oono et al. | 123/690 |
| 2006/0054149 | A1 * | 3/2006 | Uchiyama | 123/676 |
| 2007/0079809 | A1 * | 4/2007 | Oono | 123/456 |
| 2007/0209430 | A1 * | 9/2007 | Awano et al. | 73/119 A |
| 2007/0251502 | A1 * | 11/2007 | Takayanagi et al. | 123/458 |
| 2009/0205413 | A1 * | 8/2009 | Yamauchi et al. | 73/114.41 |
| 2010/0108035 | A1 * | 5/2010 | Dusa et al. | 123/453 |
| 2010/0122690 | A1 * | 5/2010 | Miyake et al. | 123/457 |
| 2012/0065868 | A1 * | 3/2012 | Ando | 701/103 |

FOREIGN PATENT DOCUMENTS

| | | | |
|---|---|---|---|
| CN | 101418757 | A | 4/2009 |
| JP | 10-077892 | A | 3/1998 |
| JP | 11-210532 | A | 8/1999 |
| JP | 2000-161114 | A | 6/2000 |
| JP | 3416682 | B2 | 4/2003 |
| JP | 2003-176746 | A | 6/2003 |
| JP | 2004-316518 | A | 11/2004 |

* cited by examiner

FUEL SUPPLY DEVICE AND FUEL SUPPLY CONTROL METHOD FOR INTERNAL COMBUSTION ENGINE

TECHNICAL FIELD

The present invention relates to a pressure control of a fuel supply system of an internal combustion engine.

BACKGROUND ART

In a direct-injection spark-ignition internal combustion engine, a high injection pressure is required to atomize a spray of fuel. Accordingly, there is known a fuel supply device for pressure-feeding fuel in a fuel tank by a low-pressure side electromagnetic fuel pump (low-pressure pump), accumulating this low-pressure fuel in a common rail after highly pressurizing it by a high-pressure side mechanical fuel pump (high-pressure pump) and injecting the fuel into a combustion chamber by an injection pulse corresponding to a fuel pressure (fuel injection pressure) in the common rail. A feedback control is generally performed based on a detection value of a pressure sensor to keep the fuel injection pressure at a target injection pressure set according to an operating state of the internal combustion engine.

If the pressure sensor (high-pressure fuel pressure sensor) for detecting the fuel injection pressure does not indicate an accurate value due to disconnection or the like in the fuel supply device as described above, the fuel injection pressure cannot be accurately controlled.

Accordingly, in JP10-077892A issued in 1998 by the Japan Patent Office, a high-pressure pump is controlled to be in a maximum discharge amount state and a fuel injection pressure is estimated to be a maximum value in mechanism when a high-pressure fuel pressure sensor experiences disconnection or the like.

SUMMARY OF INVENTION

However, in the control according to the conventional technology, an injection pulse is calculated based on the fuel injection pressure higher than an actual fuel injection pressure until the actual fuel injection pressure reaches a maximum value after the high-pressure pump is set at a maximum discharge pressure. When a fuel injection amount is the same, the higher the fuel injection pressure, the shorter the injection pulse. Thus, if the injection pulse is calculated based on the fuel injection pressure higher than the actual fuel injection pressure, there is a possibility that a necessary amount of fuel cannot be injected.

Accordingly, an object of the present invention is to provide a control device capable of controlling a fuel injection pressure so that fuel injection can be performed by an appropriate injection pulse corresponding to an actual fuel pressure also when a high-pressure sensor experiences disconnection or the like.

To achieve the above object, the present invention comprises a low-pressure fuel pump for sucking fuel from a fuel tank, a high-pressure fuel pump for pressurizing the fuel discharged from the low-pressure fuel pump, and an accumulator for accumulating the fuel pressurized by the high-pressure fuel pump. The present invention, also comprises fuel injection valves for directly injecting the fuel accumulated in the accumulator into cylinders of an internal combustion engine, a relief valve for restricting an upper limit value of a fuel pressure in the accumulator, and a high-pressure fuel pressure sensor for detecting the fuel pressure in the accumulator. The present invention further comprises a fuel pressure control means for setting a target fuel injection pressure corresponding to an engine operating state and controlling the high-pressure fuel pump based on a detection value of the high-pressure fuel pressure sensor and the target fuel injection pressure so that the fuel pressure in the accumulator reaches the target fuel injection pressure. The fuel pressure control means is capable of detecting an abnormality of the high-pressure fuel pressure sensor and regards the present target fuel injection pressure as the detection value of the high-pressure fuel pressure sensor and sets the high-pressure fuel pump in an operational state with a maximum discharge amount or a non-operational state when detecting the abnormality.

The detail of this invention and other features and advantages thereof are described in detail below and illustrated in the accompanying drawings.

DESCRIPTION OF EMBODIMENTS

Figure 1:
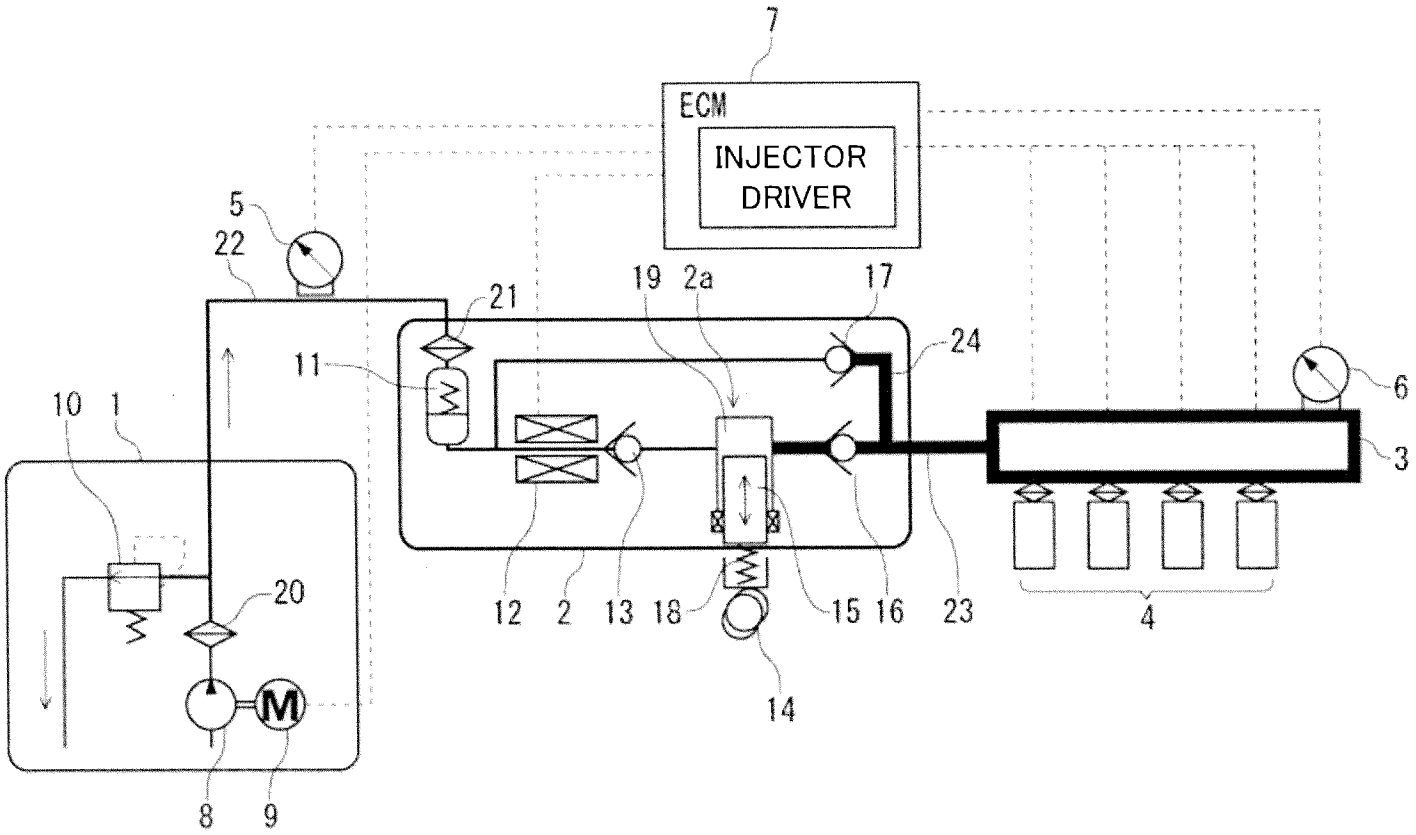
FIG. 1 is a configuration diagram of a fuel supply injection device according to a first embodiment of the present invention.

FIG. 1 is a configuration diagram of a fuel supply device of a vehicle internal combustion engine to which a first embodiment of the present invention is applied. The internal combustion engine here is a direct-injection spark-ignition internal combustion engine.

A low-pressure fuel pump 8 to be driven by a motor 9 is provided in a fuel tank 1 of a vehicle. Specifically, there are provided a low-pressure fuel pump 8 for pressure-feeding fuel in the fuel tank 1, a fuel filter 20 for filtering the fuel at a discharge side of the low-pressure fuel pump 8 and a low-pressure pressure regulator 10 for regulating a discharge side pressure to be a constant pressure (normally about 0.3 to 0.5 megapascals (MPa)) by returning excess fuel to the fuel tank 1.

The fuel pressure-fed by the low-pressure fuel pump 8 is supplied to a high-pressure fuel pump 2 via a fuel filter 21 and a fuel damper 11 through a low-pressure fuel passage 22. A low-pressure fuel pressure sensor 5 for detecting a fuel pressure in the passage is provided in the low-pressure fuel passage 22. A fuel pressure sensor voltage value detected by the low-pressure fuel pressure sensor 5 is input in the form of a signal to an engine control unit (ECU) 7 and the input voltage value is converted into a pressure value in the ECU 7.

The ECU 7 is configured by a microcomputer including a central processing unit (CPU), a read only memory (ROM), a random access memory (RAM) and an input/output interface (I/O interface). The ECU 7 can also be configured by a plurality of microcomputers.

The high-pressure fuel pump 2 is mainly composed of a plunger pump 2*a*. The plunger pump 2*a* changes the volume of a pump chamber 19 by reciprocating a plunger 15 against a biasing force of a spring 18 by a cam 14. The plunger pump 2*a* sucks the fuel into the pump chamber 19 via a suction-side one-way valve 13 during a suction stroke of the plunger 15 and discharges the fuel in the pump chamber 19 via a discharge-side one-way valve 16 during a discharge stroke of the plunger 15, i.e. during a stroke in which the plunger 15 passes a bottom dead center and moves upward. Note that the cam 14 is coupled to a cam shaft of the internal combustion engine.

The discharge side of the high-pressure fuel pump 2 is connected to a common rail 3 as an accumulator, and fuel injection valves 4 each facing a combustion chamber of each cylinder of the internal combustion engine are connected to the common rail 3. Accordingly, the fuel discharged from the high-pressure fuel pump 2 flows into the common rail 3 and is injected from there into the cylinders of the internal combustion engine via the fuel injection valves 4 provided in the respective cylinders. Further, a high-pressure fuel pressure sensor 6 for detecting a fuel pressure in the common rail 3 is attached to the common rail 3. A fuel pressure sensor voltage value detected by the high-pressure fuel pressure sensor 6 is input to the ECU 7. The input voltage value is converted into a pressure value in the ECU 7. Note that the fuel pressure sensor voltage values of the low-pressure fuel pressure sensor 5 and the high-pressure fuel pressure sensor 6 are both in a proportional relationship to the pressure value.

Note that a signal indicating a minimum fuel pressure is input to the ECU 7 if the high-pressure fuel pressure sensor 6 is shorted and a signal indicating a maximum fuel pressure is input to the ECU 7 if the high-pressure fuel pressure sensor 6 is disconnected.

The high-pressure fuel pump 2 further includes a solenoid 12. The solenoid 12 is provided at a side opposite to the plunger pump 2*a* across the suction-side one-way valve 13. The solenoid 12 can keep the suction-side one-way valve 13 in an open state regardless of a pressure in the pump chamber 19 by an electromagnetic force generated by energization. Thus, by ending the energization to the solenoid 12 at any timing during the discharge stroke of the plunger pump 2*a*, a start timing of a discharging operation of the plunger pump 2*a*, i.e. a discharge amount can be controlled.

A return pipe 24 is branched off from a high-pressure fuel pipe 23 between the discharge-side one-way valve 16 and the common rail 3. A relief valve 17 is disposed in the return pipe 24. When the pressure in the high-pressure fuel pipe 23 exceeds a given pressure, e.g. about 15 MPa, the relief valve 17 is opened and a part of the fuel is returned to between the fuel damper 11 and the solenoid 12. This can prevent the pressure in the common rail 3 from increasing above the given pressure. That is, an upper limit value of the fuel pressure at which the fuel is injected from the fuel injection valves 4 can be restricted.

Here is described a fuel pressure control in the common rail 3 to control the fuel pressure at which the fuel is injected from the fuel injection valves 4.

The fuel pressure is feedback-controlled to reach a target fuel pressure to be described later by a flow balance between a pump discharge amount and a fuel injection amount by controlling an energization end timing of the solenoid 12, i.e. a valve closing timing of the suction-side one-way valve 13 during the discharge stroke to control the discharge amount of the high-pressure fuel pump 2. Specifically, the pump discharge amount is feedback-controlled to eliminate a deviation between a detection value of the high-pressure fuel pressure sensor 6 and the target fuel pressure during the operation with a fuel injection amount corresponding to the operating state of the internal combustion engine 1.

Figure 4:
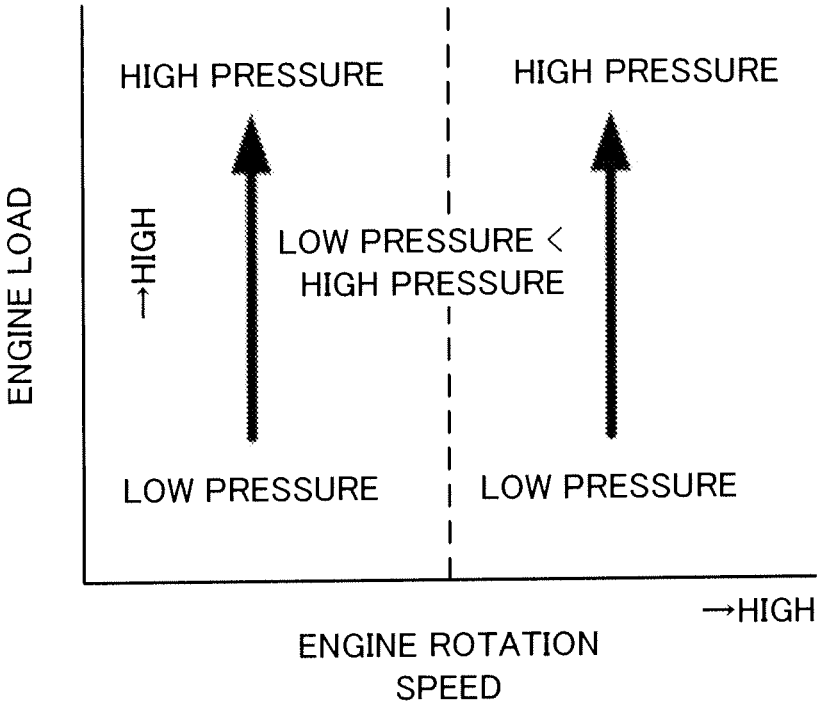
FIG. 4 is a chart showing an example of a target fuel injection pressure map stored in the control unit.

The target fuel pressure is set according to the operating conditions, e.g. engine rotation speed and load by the ECU 7. For example, the target fuel pressure is set by referring to a map in which the target fuel pressure is higher in a high engine rotation speed region than in a low engine rotation speed region if the engine load is the same and a higher target fuel pressure is set as the engine load increases if the engine rotation speed is the same as shown in FIG. 4.

A target fuel injection amount of the fuel injection valves 4 is set according to the operating conditions by the ECU 7. The ECU 7 calculates an injection pulse width for injecting the target fuel injection amount of fuel at the target fuel pressure and controls a valve opening period of the fuel injection valves 4 based on the calculated injection pulse width. For example, even if the target fuel injection amount is the same, the higher the target fuel pressure, the shorter the injection pulse width and, conversely, the lower the target fuel pressure, the longer the injection pulse width.

If the high-pressure fuel pressure sensor 6 can no longer detect an accurate fuel pressure due to disconnection or the like, the following problem occurs.

If the high-pressure fuel pressure sensor 6 is disconnected, a signal indicating a maximum fuel pressure is input from the fuel pressure sensor 6 to the ECU 7. Thus, if the ECU 7 controls the injection pulse width of the fuel injection valves 4 based on this signal, an injection pulse width shorter than the one based on an actual fuel pressure is set, with the result that the target fuel injection amount of fuel cannot be injected. Further, since a deviation from the target fuel pressure increases on the surface, the ECU 7 actuates the high-pressure fuel pump 2 to reduce the fuel pressure by the feedback control described above and the actual fuel pressure decreases. In this way, the ECU 7 performs such a control as to set the injection pulse width to be shorter than an actually necessary injection pulse width and further reduce the actual fuel pressure that there is a high possibility that a necessary amount of fuel is not injected.

Accordingly, the ECU 7 performs a control described below to avoid lean misfire and engine stall even if the high-pressure fuel pressure sensor 6 cannot accurately detect the fuel pressure in the common rail 3.

Figure 2:
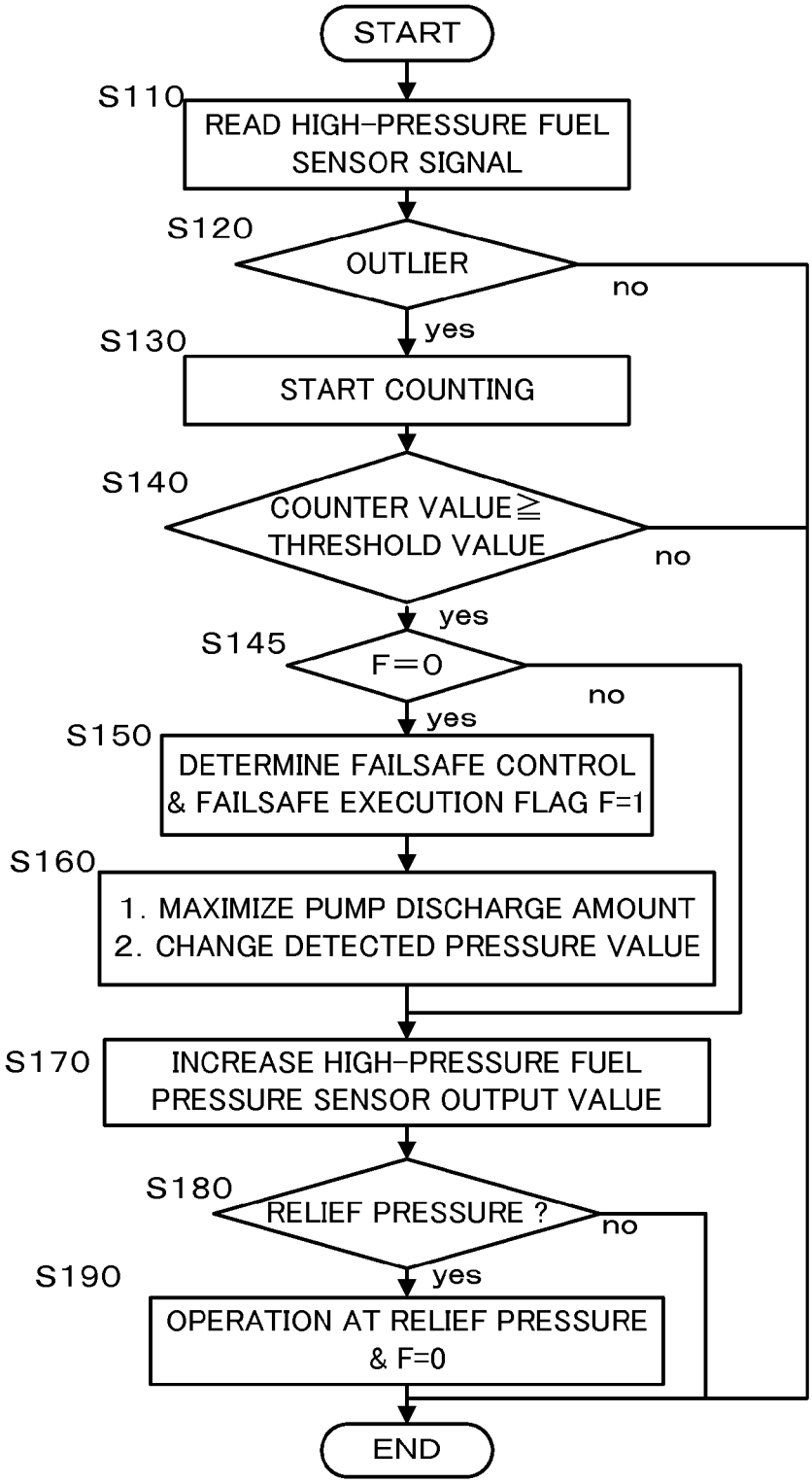
FIG. 2 is a flow chart showing a control routine executed by a control unit according to the first embodiment of the present invention when a reading of a high-pressure fuel sensor is an outlier.

FIG. 2 is a flow chart showing a control routine executed by the ECU 7. This control routine is repeatedly executed, for example, at a time interval of several ms during the operation of the internal combustion engine 1.

In Step S110, the ECU 7 reads the fuel pressure sensor voltage value from the high-pressure fuel pressure sensor 6.

In Step S120, the ECU 7 determines whether or not the detected pressure value converted from the read fuel pressure sensor voltage value is an outlier. The "outlier" mentioned here is a value beyond the range of a voltage value input from the high-pressure fuel pressure sensor 6 during the operation free from disconnection and the like, i.e. during normal operation. For example, if a measurement range of the high-pressure fuel pressure sensor 6 is 0 to 5 [V], the range of a voltage value to be used during normal operation is set to be 0.5 to 4.5 [V] and an outlying value of this range is an "outlier". The outlier is a value smaller than the usable range during normal operation if the high-pressure fuel pressure sensor 6 is shorted while being a value larger than the usable range during normal operation if the high-pressure fuel pressure sensor 6 is disconnected.

The ECU 7 directly ends the process if the pressure value is not an outlier, and performs the processing of Step S130 if it is an outlier.

The ECU 7 starts counting a period during which outliers are detected in Step S130 and determines whether or not a counter value has exceeded a threshold value set in advance in Step S140. The threshold value is, for example, set at about 10 ms.

The process is directly finished unless the threshold value has been exceeded and the processing of Step S145 is performed if the threshold value has been exceeded.

In Step S145, the ECU 7 determines whether or not a failsafe control execution flag F is set at 0. The processing of Step S150 is performed if F=0 and the processing of Step S170 is performed if F=1. Note that F=0 in the first calculation.

In Step S150, the ECU 7 determines the start of a failsafe control and sets the failsafe control execution flag F at 1.

The ECU 7 counts time until the threshold value is exceeded without directly determining the start of the failsafe control when detecting an outlier in order to prevent erroneous diagnosis when the fuel pressure sensor voltage value becomes larger due to the occurrence of noise.

In Step S160, the ECU 7 maximizes the discharge amount of the high-pressure fuel pump 2 by ending energization to the solenoid 12 at a timing at which the discharge stroke of the plunger 15, for example, is started. On the other hand, the ECU 7 corrects the detected pressure value of the high-pressure fuel pressure sensor 6 to a value equal to the present target fuel injection pressure.

The fuel injection pulse width of the fuel injection valves 4 is set based on the detected pressure value of the high-pressure fuel pressure sensor 6. In a state where the detected pressure value is fixed at a maximum value unlike an actual common rail pressure, the fuel injection pulse width is set to be excessively short. Accordingly, the detected pressure value is corrected to the value equal to the target fuel injection pressure. In this way, the fuel injection pulse width of the fuel injection valves 4 can be set based on the detected pressure value approximate to the actual common rail pressure.

If the discharge amount of the high-pressure fuel pump 2 is maximized, the fuel pressure in the common rail 3 increases and eventually reaches a relief pressure of the relief valve 17, and then the relief valve 17 is opened and the fuel pressure in the common rail 3 becomes constant. Thus, after the relief pressure is reached, an accurate fuel pressure in the common rail 3 can be grasped without depending on the detected pressure value of the high-pressure fuel pressure sensor 6.

The fuel pressure in the common rail 3 when the start of the failsafe control is determined in Step S150 is hardly different from the fuel pressure immediately before the start of the failsafe control is determined. The fuel pressure in the common rail 3 is made substantially equal to the target fuel injection pressure by the feedback control until the start of the failsafe control is determined. If the detected pressure value is corrected to the value equal to the present target fuel injection pressure, the detected pressure value after correction is a value substantially accurately reflecting the fuel pressure in the common rail 3 when the start of the failsafe control is determined.

In Step S170, the ECU 7 increases the detected pressure value of the high-pressure fuel pressure sensor 6, for example, according to the engine rotation speed. This is for the following reason. If the discharge amount of the high-pressure fuel pump 2 is maximized, the fuel pressure in the common rail 3 increases. Thus, unless the detected pressure value is increased by being changed to the value equal to the present target fuel injection pressure, the actual fuel pressure and the detected pressure value deviate from each other.

In Step S180, the ECU 7 determines whether or not the detected pressure value has increased up to the relief pressure. The routine is ended unless the detected pressure value has increased, whereas the detected pressure value is fixed at the relief pressure and the failsafe control execution flag F is set at 0 in Step S190 if the detected pressure value has increased up to the relief pressure. This is because the actual fuel pressure is kept at a maximum level since the relief valve 17 is opened even when the discharge amount of the high-pressure fuel pump 2 is kept at a maximum level if the detected pressure value reaches the relief pressure.

A time chart when the ECU 7 executes the control routine described above is shown in FIG. 3.

When the high-pressure fuel pressure sensor 6 is disconnected at t0, the fuel pressure sensor voltage value increases and, in association with this, the detected pressure value increases and is fixed at the maximum value. Since the deviation between the detected pressure value and the target fuel injection pressure increases during this time, the discharge amount of the high-pressure fuel pump 2 is reduced and the actual fuel pressure in the common rail 3 is reduced by the feedback control. On the other hand, since the detected pressure value is increased up to the maximum value, the fuel injection pulse width for the injection of the target fuel injection amount of fuel determined according to the operating state is reduced down to a minimum pulse width.

Figure 3:
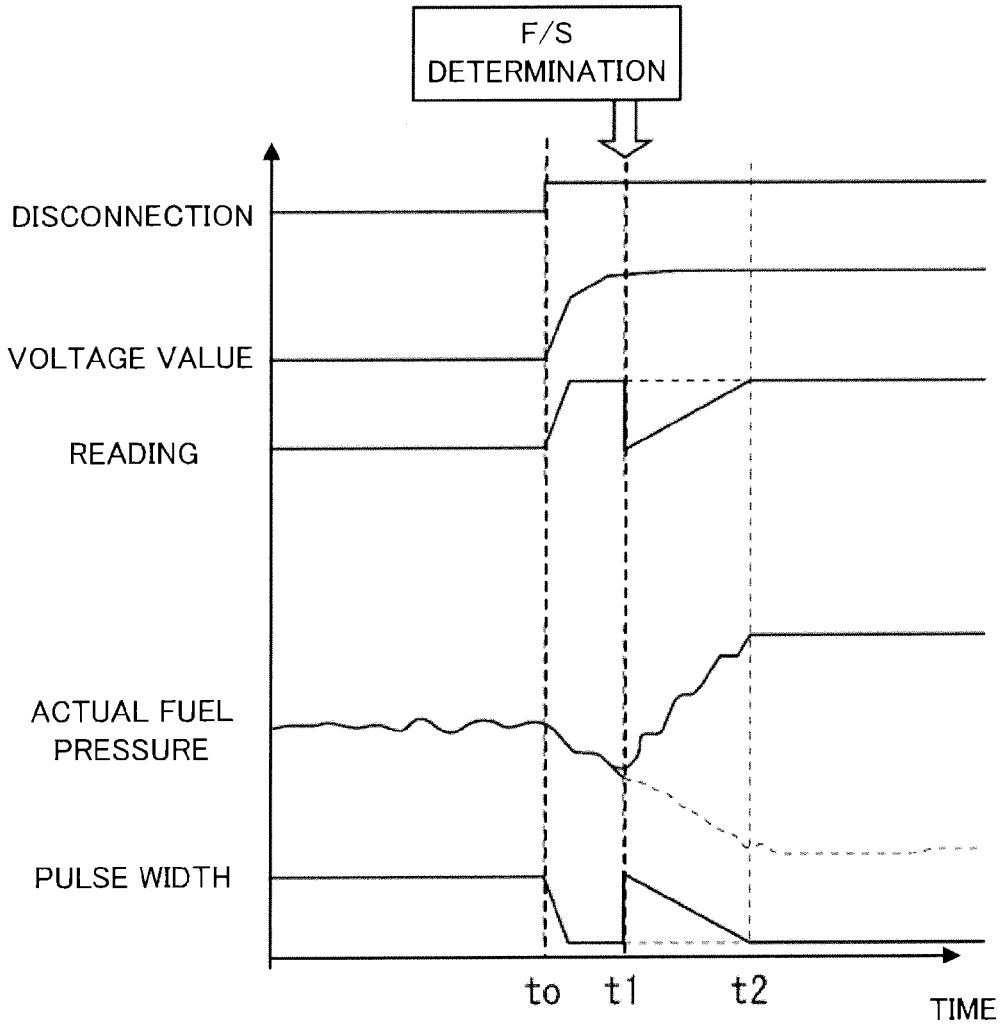
FIG. 3 is a time chart showing a control result by the control unit.

Thus, if the detected pressure value is kept at the maximum value, the fuel injection amount decreases relative to the target injection amount as the actual fuel pressure decreases as shown by broken line in FIG. 3, wherefore lean misfire is likely to occur and the engine stalls before the actual fuel pressure reaches the maximum value.

Contrary to this, in this embodiment, the detected pressure value is changed to the present target fuel injection pressure by the processing of Step S160 after the ECU 7 determines the start of the failsafe control at t1 by the processings of Steps S110 to S150. In this way, the detected pressure value is returned to a value approximate to the actual fuel pressure, with the result that the injection pulse width also approximates to a proper value corresponding to the actual fuel pressure.

Further, the ECU 7 maximizes the discharge amount of the high-pressure fuel pump 2 by the processing of Step S160 and increases the detected pressure value from there according to the engine rotation speed by the processing of Step S170. Since this causes the detected pressure value to increase as the actual fuel pressure in the common rail 3 increases, an appropriate injection pulse width corresponding to the actual fuel pressure is set. That is, since the target fuel injection amount of fuel is injected, lean misfire can be avoided.

Then, by the processings of Steps S180 and S190, the ECU 7 fixes the detected pressure value at the maximum value when the detected pressure value increased according to the engine rotation speed reaches the relief pressure at t2. Since the actual fuel pressure has also reached the maximum value in this state, a sufficient fuel injection amount can be ensured even if the injection pulse width is small.

As just described, the ECU 7 regards the present target fuel injection pressure as the detection value of the high-pressure fuel pressure sensor 6 and sets the high-pressure fuel pump 2 in an operational state with the maximum discharge amount when detecting an abnormality of the high-pressure fuel pressure sensor 6. Thus, even if the high-pressure fuel pressure sensor 6 is disconnected, the fuel can be injected with an appropriate injection pulse width corresponding to the actual fuel pressure.

Note that if there is a deviation between the target fuel injection pressure and the actual fuel pressure when the detected pressure value is changed to the target fuel injection pressure, a timing at which the detected pressure value calculated according to the engine rotation speed reaches the relief pressure and a timing at which the actual fuel pressure reaches the relief pressure may deviate. However, the actual fuel pressure reliably reaches the relief pressure by operating the high-pressure fuel pump 2 at the maximum discharge pressure, which results in the coincidence of the detected pressure value and the actual fuel pressure.

Note that although the case where the high-pressure fuel pressure sensor 6 is disconnected has been described above, the present invention can be similarly applied also in the case of a short. In the case of a short, a chart differs from the chart of FIG. 3 only in a part corresponding to t0 to t1 and is obtained by vertically inverting the chart of FIG. 3 and is similar to FIG. 3 at and after t1.

That is, during a time interval t0 to t1, the detected pressure value also decreases and is fixed at a minimum value as the fuel pressure sensor voltage value decreases. Although the actual fuel pressure is increased by the feedback control during this time, the injection pulse width increases since the fuel pressure reading is reduced. That is, the fuel injection amount becomes excessive, leading to the deterioration of exhaust performance and fuel economy performance.

Further, although the direct-injection spark-ignition internal combustion engine has been described, the present invention can be similarly applied also to a so-called direct-injection compression self-ignition internal combustion engine adopting a common rail.

A second embodiment is described.

This embodiment is similar to the first embodiment in the configuration of the fuel supply device, but a control performed such as when the high-pressure fuel pressure sensor 6 is disconnected partly differs. Accordingly, the following description is centered on different parts.

Figure 5:
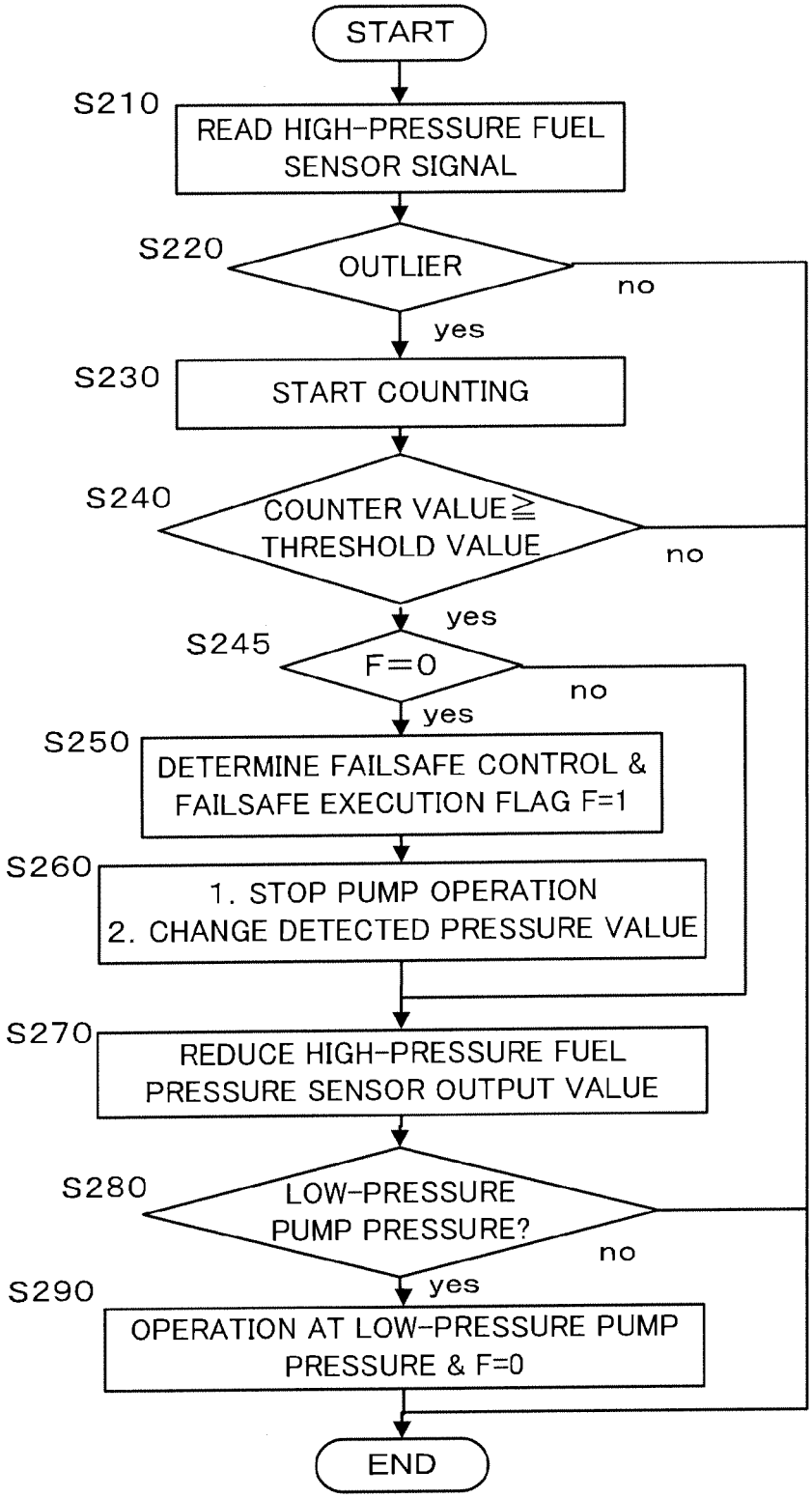
FIG. 5 is a flow chart showing a control routine executed by a control unit according to a second embodiment of the present invention when a reading of a high-pressure fuel sensor is an outlier.

FIG. 5 is a flow chart showing a control routine performed by the ECU 7. As in FIG. 2, this control routine is also repeatedly executed, for example, at a time interval of several ms. Further, Steps S210 to S250 are not described since being similar to Steps S110 to S150 of FIG. 2.

After determining to perform the failsafe control, the ECU 7 stops the operation of the high-pressure fuel pump 2, for example, by constantly energizing the solenoid 12 and the detected pressure value of the high-pressure fuel pressure sensor 6 is changed to the present target fuel injection pressure in Step S260.

If the high-pressure fuel pump 2 is set in a non-operational state, the fuel pressure in the common rail 3 decreases every time the fuel is injected and eventually decreases to a pressure given only by the low-pressure fuel pump 8, i.e. a low-pressure pump pressure. Thus, in a state where the low-pressure pump pressure is reached, an accurate fuel pressure in the common rail 3 can be grasped without being detected by the high-pressure fuel pressure sensor 6.

The detected pressure value of the high-pressure fuel pressure sensor 6 is changed to the present target fuel injection pressure for the same reason as in Step S160 of FIG. 2.

In Step S270, the ECU 7 reduces the detected pressure value of the high-pressure fuel pressure sensor 6, for example, according to the fuel injection amount. This is to accurately grasp the actual fuel pressure until the actual fuel pressure in the common rail 3 reaches the low-pressure pump pressure after the high-pressure fuel pump 2 is set in the non-operational state in Step S260.

In Step S280, the ECU 7 determines whether or not the actual fuel pressure has reached the low-pressure pump pressure and performs the processing of Step S290 if the low-pressure pump pressure has been reached while ending the routine unless the low-pressure pump pressure has been reached.

In Step S290, the ECU 7 fixes the detected pressure value at the low-pressure pump pressure and the failsafe control execution flag F is set at 0.

Since a pressure reducing valve and the like are not provided in the common rail 3, the fuel pressure is not reduced only by setting the high-pressure fuel pump 2 in the non-operational state and is reduced by injecting the fuel from the fuel injection valves 4. That is, the fuel pressure in the common rail 3 decreases faster as the fuel injection amount increases and the fuel pressure decreases more slowly as the fuel injection amount decreases. Thus, the actual fuel pressure being decreased can be accurately grasped without depending on the high-pressure fuel pressure sensor 6 if the detected pressure value is reduced according to the fuel injection amount.

Figure 6:
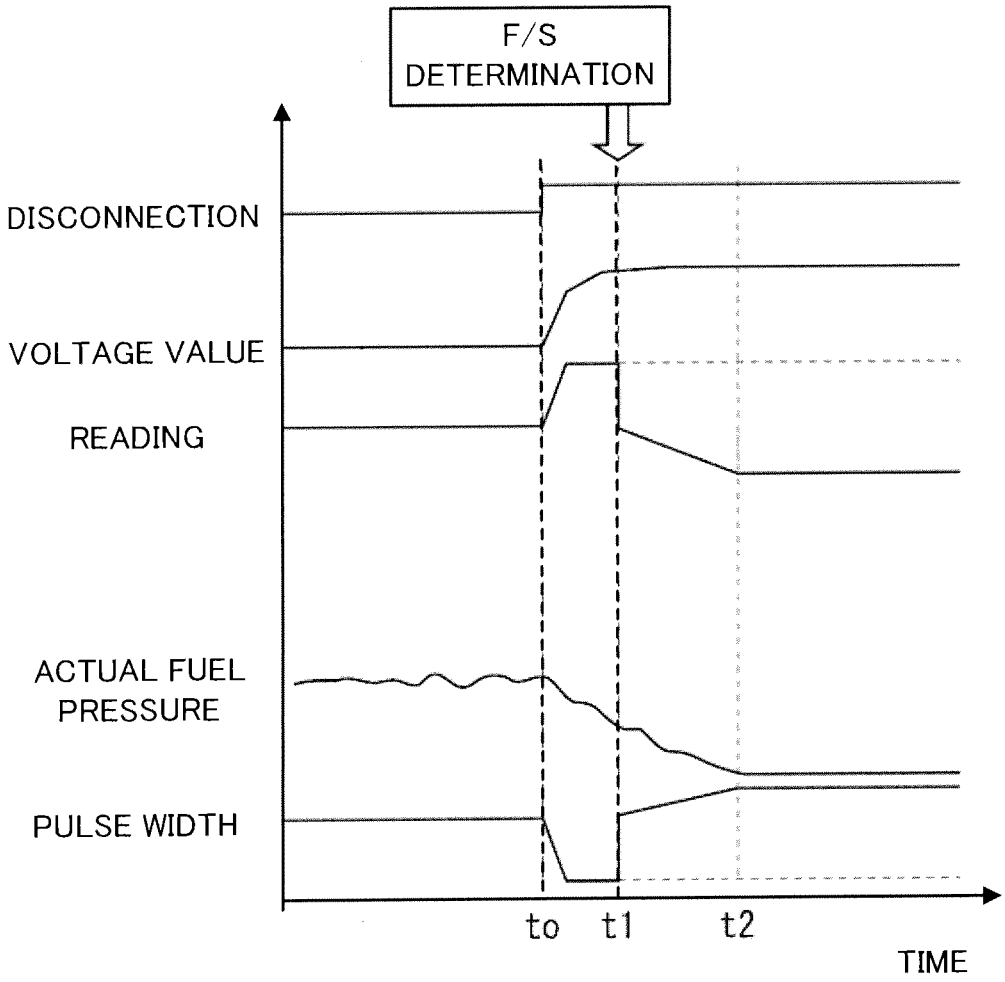
FIG. 6 is a time chart showing a control result according to the second embodiment of the present invention.

A time chart when the ECU 7 performs the above control routine is shown in FIG. 6.

The ECU 7 changes the detected pressure value to the present target fuel injection pressure by the processing of Step S260 after determining the start of the failsafe control at t1 by the processings of Steps S210 to S250. In this way, the detected pressure value returns to a value approximate to the actual fuel pressure, with the result that the injection pulse width also approximates to a value before disconnection.

Further, the ECU 7 sets the high-pressure fuel pump 2 in the non-operational state by the processing of Step S260 and reduces the detected pressure value from there according to the fuel injection amount by the processing of Step S270. Since this causes the detected pressure value to decrease as the actual fuel pressure in the common rail 3 decreases, an appropriate injection pulse width corresponding to a drop in the actual fuel pressure is set. That is, since a decrease rate of the detected pressure value substituted by the present target fuel injection pressure is set to be faster as the fuel injection amount increases and set to be slower as the fuel injection amount decreases, the fuel is injected with an appropriate injection pulse width by suppressing a deviation between the actual fuel pressure and the detected pressure value until the actual fuel pressure is reduced to the low-pressure pump pressure. Therefore, lean misfire can be avoided.

By the processings of Steps S280, S290, the ECU 7 fixes the detected pressure value at the low-pressure pump pressure when the detected pressure value reaches the low-pressure pump pressure at t2. Since the actual fuel pressure has also reached the low-pressure pump pressure in this state, a sufficient fuel injection amount can be ensured by setting a large injection pulse width.

As just described, the fuel can be injected with an appropriate injection pulse width corresponding to the actual fuel pressure even if the high-pressure fuel pressure sensor 6 is disconnected.

The present invention is not limited to the above embodiments and it is apparent that various changes can be made within the scope of the technical concept thereof.

For the above description, the contents of Japanese Patent Application No. 2009-290205 filed on Dec. 22, 2009 are hereby incorporated by reference.

The invention claimed is:

1. A fuel supply device for an internal combustion engine, comprising:

a low-pressure fuel pump for sucking fuel from a fuel tank;

a high-pressure fuel pump for pressurizing the fuel discharged from the low-pressure fuel pump;

an accumulator for accumulating the fuel pressurized by the high-pressure fuel pump, fuel injection valves for directly injecting the fuel accumulated in the accumulator into cylinders of an internal combustion engine;

a relief valve for restricting an upper limit value of a fuel pressure in the accumulator;

a high-pressure fuel pressure sensor for detecting the fuel pressure in the accumulator and a control unit for setting a target fuel injection pressure corresponding to an engine operating state, controlling the high-pressure fuel pump based on a detection value of the high-pressure fuel pressure sensor and the target fuel injection pressure so that the fuel pressure in the accumulator reaches the target fuel injection pressure and setting a fuel injection pulse width of the fuel injection valves based on the detection value of the high-pressure fuel pressure sensor;

wherein the control unit determines the presence of an abnormality of the high-pressure fuel pressure sensor when a period during which an outlier is detected has exceeded a threshold value set in advance and, when determining the presence of the abnormality of the high-pressure fuel pressure sensor, sets the high-pressure fuel pump in an operational state with a maximum discharge amount or sets the high-pressure fuel pump in a non-operational state, and regards the target fuel injection pressure at the time of determining the presence of the abnormality of the high-pressure fuel pressure sensor as the detection value of the high-pressure fuel pressure sensor and sets the fuel injection pulse width of the fuel injection valves based on the value regarded as the detection value of the high-pressure fuel pressure sensor.

2. The fuel supply device for an internal combustion engine according to claim 1, wherein the control unit continuously increases a value regarded as the detection value of the high-pressure fuel pressure sensor after setting the high-pressure fuel pump in the operational state with the maximum discharge amount when setting the high-pressure fuel pump in the operational state with the maximum discharge amount.

3. The fuel supply device for an internal combustion engine according to claim 2, wherein the control unit increases an increase rate of the value regarded as the detection value of the high-pressure fuel pressure sensor as an engine rotation speed increases and decreases the increase rate as the engine rotation speed decreases.

4. The fuel supply device for an internal combustion engine according to claim 1, wherein the control unit continuously decreases a value regarded as the detection value of the high-pressure fuel pressure sensor after setting the high-pressure fuel pump in the non-operational state when setting the high-pressure fuel pump in the non-operational state.

5. The fuel supply device for an internal combustion engine according to claim 4, wherein the control makes a decrease rate of the target fuel injection pressure faster as a fuel injection amount increases and makes the decrease rate slower as the fuel injection amount decreases.

6. A fuel supply device for an internal combustion engine, comprising:

a low-pressure fuel pump for sucking fuel from a fuel tank;

a high-pressure fuel pump for pressurizing the fuel discharged from the low-pressure fuel pump;

an accumulator for accumulating the fuel pressurized by the high-pressure fuel pump;

fuel injection valves for directly injecting the fuel accumulated in the accumulator into cylinders of an internal combustion engine;

a relief valve for restricting an upper limit value of a fuel pressure in the accumulator;

a high-pressure fuel pressure sensor for detecting the fuel pressure in the accumulator; and a fuel pressure control means for setting a target fuel injection pressure corresponding to an engine operating state, controlling the high-pressure fuel pump based on a detection value of the high-pressure fuel pressure sensor and the target fuel injection pressure so that the fuel pressure in the accumulator reaches the target fuel injection pressure and setting a fuel injection pulse width of the fuel injection valves based on the detection value of the high-pressure fuel pressure sensor;

wherein the fuel pressure control means determines the presence of an abnormality of the high-pressure fuel pressure sensor when a period during which an outlier is detected has exceeded a threshold value set in advance and, when determining the presence of the abnormality of the high-pressure fuel pressure sensor, sets the high-pressure fuel pump in an operational state with a maximum discharge amount or sets the high-pressure fuel pump in a non-operational state, and regards the target fuel injection pressure at the time of determining the presence of the abnormality of the high-pressure fuel pressure sensor as the detection value of the high-pressure fuel pressure sensor and sets the fuel injection pulse width of the fuel injection valves based on the value regarded as the detection value of the high-pressure fuel pressure sensor.

7. A fuel supply method for an internal combustion engine having a low-pressure fuel pump for sucking fuel from a fuel tank, a high-pressure fuel pump for pressurizing the fuel discharged from the low-pressure fuel pump, an accumulator for accumulating the fuel pressurized by the high-pressure fuel pump fuel injection valves for directly injecting the fuel accumulated in the accumulator into cylinders of the internal combustion engine a relief valve for restricting an upper limit value of a fuel pressure in the accumulator and a high-pressure fuel pressure sensor for detecting the fuel pressure in the accumulator the method comprising:

setting a target fuel injection pressure corresponding to an engine operating state;

controlling the high-pressure fuel pump based on a detection value of the high-pressure fuel pressure sensor and the target fuel injection pressure so that the fuel pressure in the accumulator reaches the target fuel injection pressure;

setting a fuel injection pulse width of the fuel injection valves based on the detection value of the high-pressure fuel pressure sensor; and setting the high-pressure fuel pump in an operational state with a maximum discharge amount or setting the high-pressure fuel pump in a non-operational state when determining the presence of an abnormality of the high-pressure fuel pressure sensor during a period in which an outlier is detected has exceeded a threshold value set in advance, and regarding the target fuel injection pressure at the time of determining the presence of the abnormality of the high-pressure fuel pressure sensor as the detection value of the high-pressure fuel pressure sensor and setting the fuel injection pulse width of the fuel injection valves based on the value regarded as the detection value of the high-pressure fuel pressure sensor.

* * * * *